US005285842A

United States Patent [19]

Chagnot

[11] Patent Number: 5,285,842

[45] Date of Patent: Feb. 15, 1994

[54] HEAT RECOVERY VENTILATOR

[75] Inventor: Catherine J. Chagnot, Athen, Ohio

[73] Assignee: Stirling Technology, Inc., Athens, Ohio

[21] Appl. No.: 729,220

[22] Filed: Jul. 12, 1991

Related U.S. Application Data

[63] Continuation-in-part of Ser. No. 665,976, Mar. 7, 1991, Pat. No. 5,183,098, which is a continuation-in-part of Ser. No. 395,044, Aug. 17, 1989, Pat. No. 5,069,272.

[51] Int. Cl.[5] ..... F28D 19/04

[52] U.S. Cl. ..... 165/7; 165/8; 165/9; 165/10; 165/54

[58] Field of Search ..... 165/7, 8, 9, 10, 54

[56] References Cited

U.S. PATENT DOCUMENTS

| | | | |
|---|---|---|---|
| 1,654,294 | 12/1927 | Ljungstrom | 165/8 |
| 2,807,258 | 9/1957 | Pennington | 165/7 |
| 3,733,791 | 5/1973 | Dravnieks | 55/390 |
| 4,825,936 | 5/1989 | Hoagland et al. | 165/8 |
| 5,183,098 | 2/1993 | Chagnot | 165/8 |

FOREIGN PATENT DOCUMENTS

| | | |
|---|---|---|
| 30863 | 6/1981 | European Pat. Off. . |
| 2318007 | 10/1974 | Fed. Rep. of Germany . |
| 2839112 | 3/1979 | Fed. Rep. of Germany . |
| 3125504 | 2/1983 | Fed. Rep. of Germany . |
| 138992 | 8/1983 | Japan . |

*Primary Examiner*—Albert W. Davis, Jr.
*Attorney, Agent, or Firm*—Killworth, Gottman, Hagan & Schaeff

[57] ABSTRACT

A heat recovery ventilator having a rotary wheel heat exchanger includes a unique configuration for driving both the rotary wheel heat exchanger and impellers to provide an inexpensive, compact and light-weight ventilator unit adaptable for use across a wide range of residential, commercial and industrial applications. A random matrix media is also used to provide high thermal efficiency in exchanging heat and moisture between inlet and exhaust air streams.

30 Claims, 9 Drawing Sheets

14c
10
38
32
92
50
90
14b
82
86
14f
14
16
100
14e
69
72
31a
25
29
18
76
77
70
31a
33
74
23
47
33
14d
67
12
14a
31
15
31

FIG-6
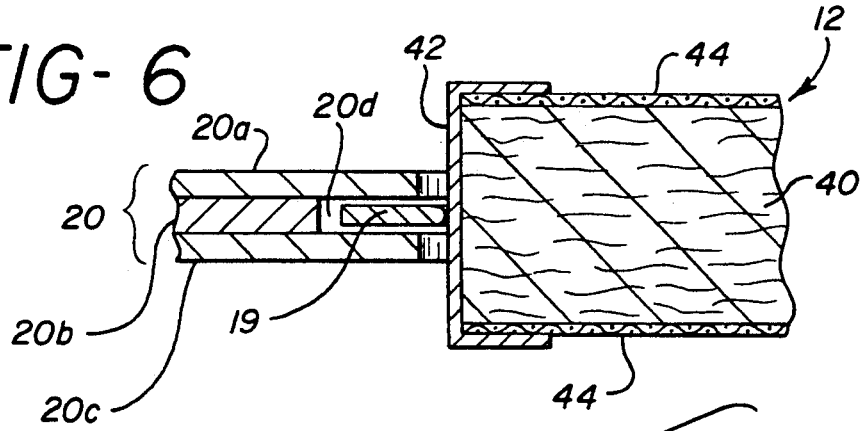
FIG-7
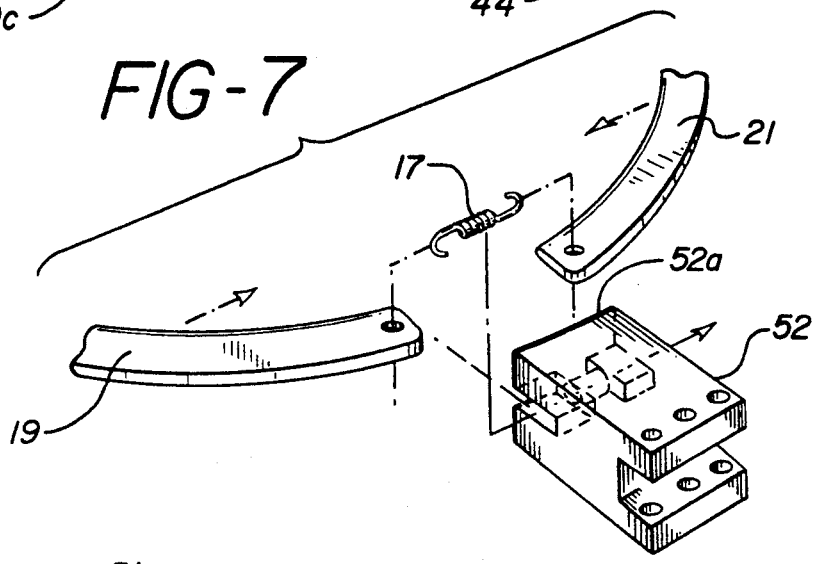
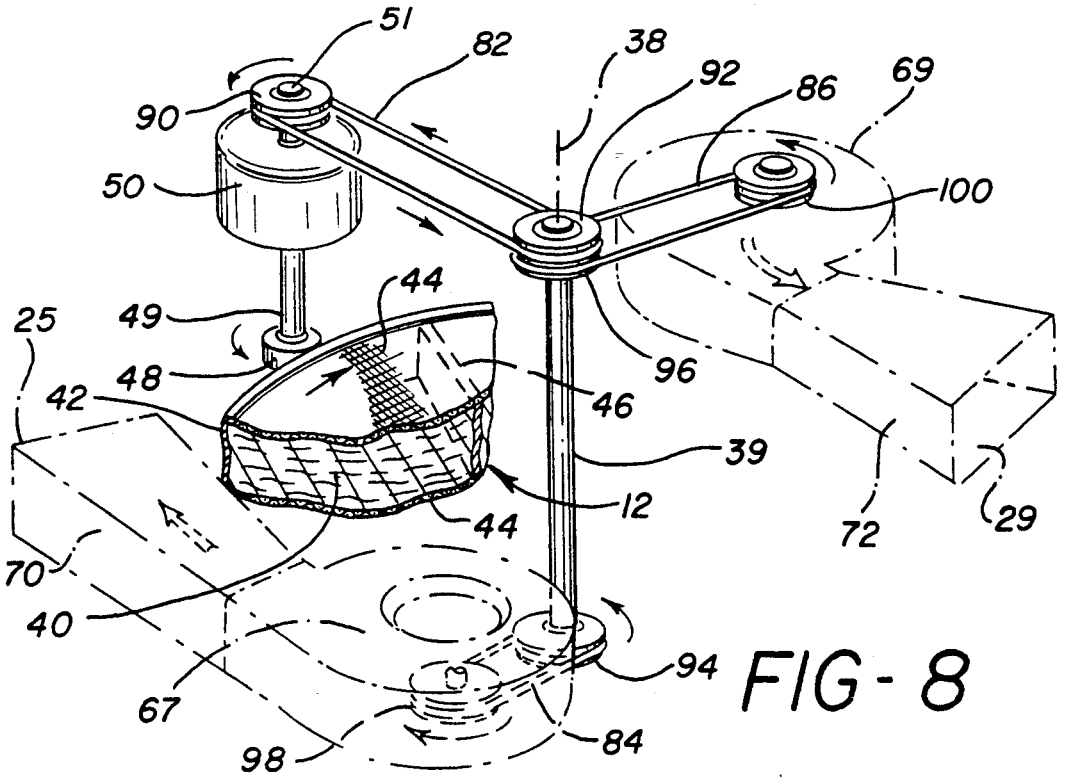
FIG-8

38
50A
50B
24
49a
49c
10
25
102
32
27
D
69a
28a
22
102
102
49b
26a
74
76
29
20
90
48
12
67a
16
102
30
14
23
22
D
52
52
104
34
36
18
D
24

48a
50
106
12
42
108

HEAT RECOVERY VENTILATOR

CROSS-REFERENCE TO RELATED APPLICATIONS

This is a continuation-in-part of U.S. application Ser. No. 665,976, filed Mar. 7, 1991, now U.S. Pat. No. 5,183,098, issued Feb. 2, 1993 which is itself a continuation-in-part of U.S. application Ser. No. 395,044, filed Aug. 17, 1989, now U.S. Pat. No. 5,069,272, issued Dec. 3, 1991, the disclosures of which are hereby incorporated by reference.

BACKGROUND OF THE INVENTION

This invention relates to heat recovery ventilators used to obtain thermally efficient ventilation of buildings and dwellings, and in particular, to those ventilators including rotary wheel heat exchangers.

Heat exchangers are used in ventilation systems installed in residential, commercial and industrial buildings to extract and remove heat and/or moisture from one air stream and transfer the heat and/or moisture to a second air stream. In particular, rotary wheel heat exchangers are known wherein a wheel rotates in a housing through countervailing streams of exhaust and fresh air, in the winter extracting heat and/or moisture from the exhaust stream and transferring it to the fresh air stream. In the summer, rotary wheel heat exchangers extract heat and moisture from the fresh air stream and transfer it to the exhaust stream, preserving building air conditioning while providing desired ventilation.

Fans or blowers typically are used to create pressures necessary for the countervailing streams of exhaust and fresh air to pass through the rotary wheel heat exchanger. Some ventilators, however, are designed for use in existing heating, ventilating, and air conditioning (HVAC) systems which have sufficient air pressure to drive the countervailing streams, and may or may not also include fans or blowers.

Various media have been developed for use in heat recovery ventilators to enhance heat and moisture transfer. Typically, heat exchangers in the prior art employ a plurality of parallel passages running in the direction of flow, such as shown in Marron et. al., U.S. Pat. No. 4,093,435 and Coellner, U.S. Pat. No. 4,594,860. Such passages must be sufficiently small to maximize the total surface area for heat transfer, yet sufficiently large relative to their length to minimize resistance to gas flow. These constraints have made the materials used as the heat exchanger media critical to the effectiveness of such rotary wheel heat exchangers. A continuing need exists for improved heat exchanger media and improved designs for rotary wheel heat exchangers which will increase the efficiency of heat transfer between the countervailing air streams, and will avoid the exacting material and design restrictions found in the prior art.

The pursuit of thermally efficient ventilation for rooms and buildings using rotary wheel heat exchangers has produced many heat recovery ventilators which are rather large, non-portable, and require fixed installation, such as the heat exchanger disclosed by Pennington, U.S. Pat. No. 2,807,258. A number of somewhat smaller, non-portable heat recovery ventilators have been developed using rotary drum-type heat exchangers, such as that of Munters, British Patent No. 738211. An even more compact window-mountable ventilator employing, however, a stationary heat exchanger, has been developed by Becker, U.S. Pat. No. 4,874,042. Nonetheless, the need continues to exist for compact, portable heat exchangers and heat recovery ventilators which can achieve thermally efficient ventilation, and which may be used without requiring modification of existing buildings or ductwork in residential, commercial and industrial environments.

Thermally efficient ventilation of residential, commercial and industrial buildings is of increasing importance. In addition to ordinary ventilation requirements, ventilation is needed to remove the hazardous build-up of radon, formaldehydes, carbon dioxide and other pollutants which otherwise accumulate in enclosed areas from various sources. Such ventilation requirements present a further need for inexpensive, portable, compact, and yet efficient heat recovery ventilators, which are capable of window-mounting or connection to existing systems. Because homes, as well as businesses, are affected by such pollutants, the need also exists for such heat recovery ventilators to be consumer-oriented and easy to maintain.

SUMMARY OF THE INVENTION

The present invention meets these needs by providing an inexpensive, compact and efficient rotary wheel heat recovery ventilator which may be designed to fit into room windows, stand alone as a larger unit, or be incorporated into existing air handling systems to satisfy the ventilation needs of residential, commercial and industrial buildings. The present invention is also both inexpensive and easy to operate and maintain. Use of a novel low cost heat exchanger medium provides an average heat transfer effectiveness in excess of 90% regardless of temperature difference between inside and outside air. Further, incorporation of various design features makes filters and belts accessible from a front, inside panel for easy maintenance of the heat recovery ventilator.

In accordance with the present invention, a heat recovery ventilator is provided in a housing divided into two sections which convey first and second streams of air, respectively. A rotary wheel heat exchanger is disposed in the housing to rotate through the first and second sections. Means for forcing the first and second streams of air through the first and second section are, preferably, impellers, such as those used in blowers or fans, rotatably disposed in impeller housings. Preferably, centrifugal impellers, such as those used in blowers, are used, disposed in centrifugal impeller housings. Alternatively, means for forcing may comprise axial impellers, such as those used in fans, disposed in axial impeller housings. The present invention incorporates a compact design wherein a single source of rotary power drives both the rotary wheel heat exchanger and the impellers. This feature eliminates the cost and noise associated with employing a plurality of motors drive the heat exchanger and impellers individually. Use of a single source of rotary power also provides a degree of design freedom, in that the impeller speed may be varied as needed rather than limited by available speeds from blower or fan manufacturers.

The use of one source of rotary power in a heat recovery ventilator is made possible in the present invention by a unique configuration for transmitting the rotary power. The source of rotary power preferably is a drive motor having two drive shafts. A first means for transmitting rotary power rotates the heat exchanger about a central axis. The first means for transmitting preferably includes a drive wheel attached to the drive motor at its first drive shaft. The drive wheel frictionally engages the periphery of the rotary wheel heat exchanger and causes it to rotate. A second means for transmitting rotary power preferably drives the impellers with a central shaft which extends through the central axis of the rotary wheel heat exchanger, and which is freely rotatable therethrough without effect on the rotation of the heat exchanger. The second means for transmitting rotary power further preferably includes a first pulley attached to and rotated by the second drive axle of the drive motor, and a first drive belt engaged in the first pulley. The first drive belt also engages a second pulley attached to the central shaft, rotating the central shaft. The central shaft preferably extends on both sides of the heat exchanger. On opposite sides thereof, third and fourth pulleys and respective second and third belts therein, engage fifth and sixth pulleys on the impellers, to rotatably drive the first and second impellers, respectively. Shaft bearing assemblies are disposed in mounting angles which are used to support the central shaft. Further, at least one bearing assembly is also disposed along the central axis to, in turn, support the rotary wheel heat exchanger on the central shaft, whereon it is freely rotatable without effect on the rotation of the central shaft. This compact configuration has been found to enable a single source of rotary power to drive the rotating components of the present invention at different speeds, using a minimum of space, without requiring additional seals and without presenting additional sealing problems between the streams of air in the first and second sections of the housing.

Alternative first means for transmitting rotary motion to the rotary wheel heat exchanger include a drive pulley replacing the drive wheel previously described, and a heat exchanger drive belt extending around the periphery of the container. Means for retaining the heat exchanger drive belt on the container may include a feature such as a groove, indentation, or a pair of generally parallel raised ribs. Such retaining means are preferably provided on the periphery of the container.

Alternative configurations of the second means for transmitting rotary motion are also provided. In one alternative configuration, the first drive belt is used to both drive the central shaft and the impeller adjacent thereto, eliminating one drive belt and a pulley. In another alternative configuration, the shaft bearing assemblies are disposed in two mounting angles on each side of the rotary wheel heat exchanger. And in a third configuration of the second means for transmitting, the shaft bearing assemblies are disposed in the sides of the housing.

Regardless of the configuration used for first and second means for transmitting rotary motion, in accordance with the present invention, a single motor or source of rotary power, operating at one speed, provides rotary motion to rotate the heat exchanger at low revolutions per minute (RPM), while simultaneously rotating impellers or other means for forcing at high RPM.

Noise is also reduced in accordance with the present invention by eliminating motors otherwise required to drive the impellers in blowers or fans. The noise level may be further reduced by advantageously positioning the source of rotary power in the housing. For example, where window-mounted units are provided, the drive motor may be disposed in portions of the ventilator which extend out the window.

Freedom of design in impeller capacity, and variation in capacity in use, is made possible in accordance with the present invention in several ways. By design, the first, second, third, fourth and fifth pulleys may be sized to provide the desired or optimal impeller speed for the application. In operation, the drive motor speed may be varied by controls between fixed speeds, or within limits by a variable control.

In accordance with the present invention, the heat recovery ventilator is further provided with first and second filters to filter the first and second streams of air and to protect the rotary wheel heat exchanger from becoming dirty, loading up or clogging with particulates from the air streams. The first and second filters are positioned in the housing near the inlets to each of the first and second sections, respectively, and are made of conventional filter materials. To provide additional filtering and purification of the air the filters may, alternatively, contain activated charcoal. Regardless of the filter type, in accordance with the present invention the filters are, preferably, removable from one face of the housing, for ease of maintenance. Where the ventilator is window-mountable or otherwise extending through a wall, the preferred face is the inside, front face.

To further inhibit the build-up of particulate or other material on the heat exchanger, the centrifugal impellers are preferably positioned by the heat exchanger in the first and second streams of air nearest their respective outlets. This position advantageously provides suction pressure in one stream of air to immediately remove particulate and other material which is driven to the surface of the rotary wheel heat exchanger by the other stream of air. Similarly, moisture attracted to or condensed in the rotary wheel heat exchanger at an inlet is reintroduced in the countervailing exhaust stream, and thus the present invention may also serve as a moisture exchanger. Its function as a moisture exchanger may be enhanced or suppressed by the temperatures of the air streams and the materials or media used in the heat exchanger.

The heat recovery ventilator of the present invention may be adapted to serve in residential, commercial and industrial environments. In a first embodiment, particularly suited for use in homes and offices, the present invention is adapted for installation in a window or wall. In accordance with the first embodiment, the present invention further preferably includes a front panel which covers the front face of the housing, and defines an inlet plenum and an outlet plenum for the first and second streams of air, respectively. These plenums provide a larger inlet area than might otherwise be possible with the compact ventilator design incorporated herein. The front panel further includes vents, preferably adjustable to assist in directing the streams of air and in preventing recirculation. The shape of the front panel also inhibits recirculation. Diffuser baffles may be included in the outlet plenum to dampen the force of the second stream of air entering into a room or area. Finally, light diffusers are also preferably included on the inside of the front panel covering vents to block the view of the housing and interior components of the heat recovery ventilator through vents. The light diffusers are preferably made from a highly porous foam filter material which provides a sufficient degree of optical density, but permits substantially free flow of streams of air therethrough.

In a second embodiment, the heat recovery ventilator is adapted for use in HVAC systems. The front panel present in the first embodiment is eliminated, and no inlet and outlet plenums are provided. As the first and second streams of air are typically provided from existing ducts, the second embodiment includes means for connecting to existing ducts, pipes or the like, present in the system. Thus, as the application requires, some or all of the inlets and outlets to the first and second sections of the housing include means for connecting to existing systems. Such means for connecting include, for example, male duct nipples with corrugated ends, a flange mounted on the inside or outside of housing, a bolt pattern, or other known means for connecting to ducts, pipes, and the like.

In an alternative configuration of the second embodiment where the heat recovery ventilator connects to an existing HVAC system, but also serves to ventilate a room or space, the heat recovery ventilator may include a front panel. Thus, for example, the ventilator may include a front panel defining an inlet plenum and outlet plenum for the first and second streams of air, respectively, while the first outlet and second inlet for the first and second streams of air, respectively, are adapted with means for connecting to existing ducts.

The heat recovery ventilator of the present invention also includes a novel, low cost heat exchange media, referred to herein as random matrix media. As the heat exchanger rotates, the random matrix media transfers sensible and latent heat energy between first and second streams of air or other gas through which it passes. While the description herein refers to air, it is understood that the present invention may be used with other gases.

The random matrix media of the present invention is comprised of a plurality of interrelated small diameter, heat-retentive fibrous material, which, relative to the prior art of ordered passages, layers, strands and patterns, appear random. The random interrelation or interconnection of fibrous material, by any of various means for interrelating, results in a mat of material of sufficient porosity to permit the flow of air therethrough, yet of sufficient density to induce turbulence and provide necessary surface area for heat transfer.

The random matrix media is enclosed by a container and retained therein by various means for supporting, preferably including screens stretched over apertures in the faces of the container, and radial spokes extending from the hub of the container through the random matrix media. Seals are located between the heat exchanger and peripheral baffle, mounting angles and other elements in the housing to prevent mixing of the separate first and second streams of air.

The heat transfer efficiency of the random matrix media and related material characteristics, such as the deliberate inducement of turbulence and the large surface area for heat transfer, promote a minimal heat exchanger thickness, and assist in the provision of an inexpensive, compact, portable heat recovery ventilator.

Accordingly, it is an object of the present invention to provide a compact heat recovery ventilator having a rotary wheel heat exchanger for residential, commercial and industrial applications. It is a further object of the present invention to provide a heat recovery ventilator operable from a single source of rotary power. It is another object of the present invention to provide an inexpensive heat recovery ventilator. It is yet another object of the present invention to provide an inexpensive heat recovery ventilator by eliminating the need for more than one motor. It is a further object of the present invention to provide a heat recovery ventilator having high efficiency. It is a still further object of the present invention to provide a heat recovery ventilator which generates a minimum of noise. It is yet another object of the present invention to provide a heat recovery ventilator providing freedom in design for varying applications. Finally, it is an object of the present invention to provide a heat recovery ventilator which is user-friendly, designed for easy access to components for repair and maintenance, and which is designed to reduce the need for repair and maintenance.

BRIEF DESCRIPTION OF THE DRAWINGS

FIG. 6 is an enlarged detail cross-sectional view of the peripheral baffle and flexible seal of the present invention taken at line 6—6 in FIG. 5.

FIG. 7 is an enlarged detail perspective view of the structure of the flexible seal in the heat recovery ventilator of the present invention.

FIG. 8 is an enlarged detail perspective view of the first and second means for transmitting rotary motion from a drive motor to the rotary wheel heat exchanger and impellers in the heat recovery ventilator of the present invention.

DETAILED DESCRIPTION OF THE PREFERRED EMBODIMENT

Figure 1:
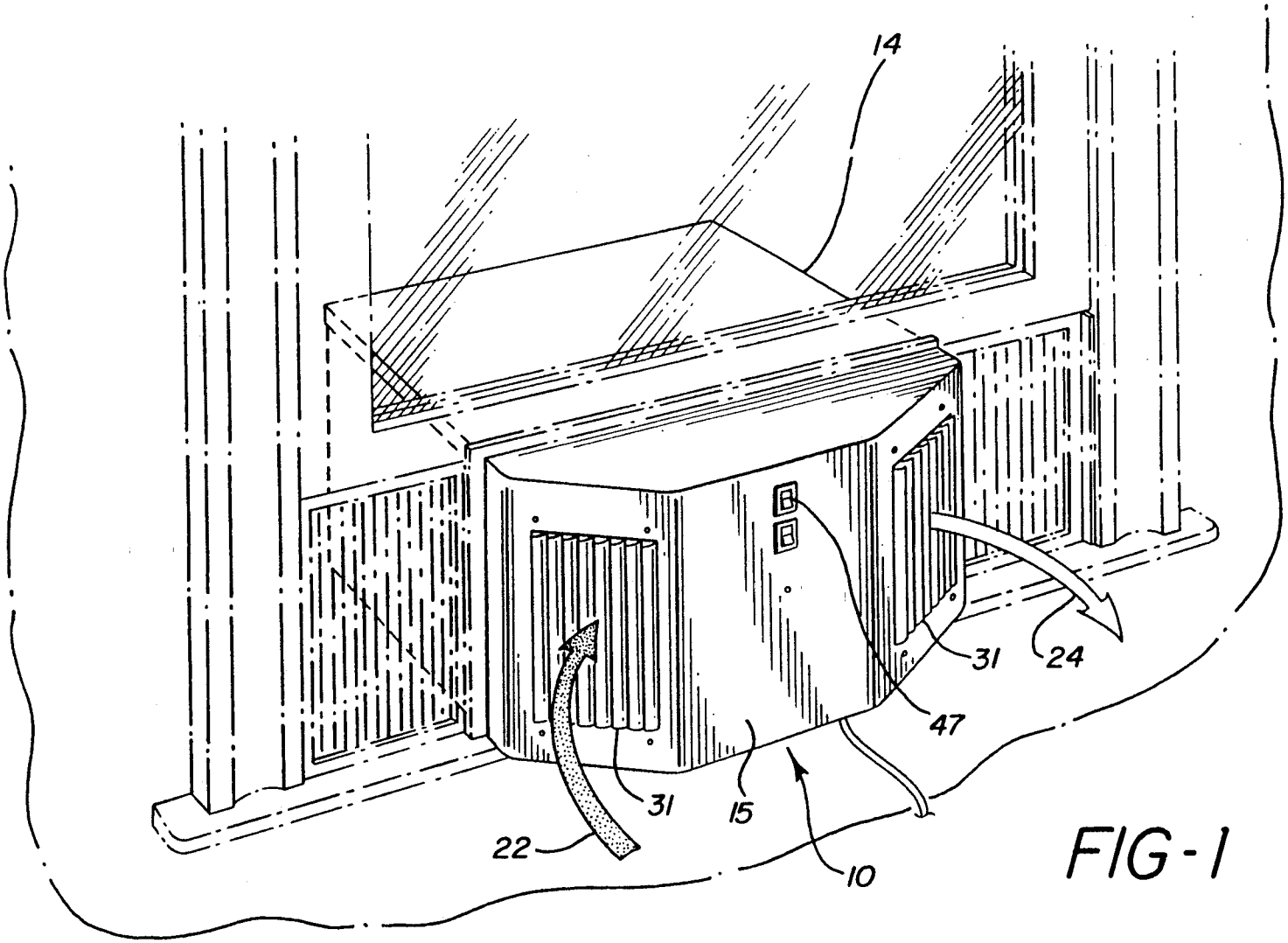
FIG. 1 is a perspective environmental view of the assembled heat recovery ventilator of the present invention in a first embodiment where the ventilator is in a stand-alone, window or wall-mountable configuration.

Referring to FIGS. 1–11, a heat recovery ventilator 10 having a rotary wheel heat exchanger 12 is shown in a housing 14 which is divided into two sections 16, 18 which convey first and second streams of air 22, 24, respectively. The rotary wheel heat exchanger 12 is disposed in an opening in peripheral baffle 20 wherein it rotates about its central axis 38 through the first and second streams of air 22, 24. Flexible seals 19 and 21, preferably of a polytetrafluoroethylene-based material, such as Teflon®, attach to peripheral baffle 20, to prevent streams of air 22, 24 from circumventing heat exchanger 12. Streams of air 22, 24 are shown in counterflow relationship, as is preferred.

The present invention is shown in two embodiments. The first embodiment, shown in FIGS. 1–5, is a standalone, window or wall mountable heat recovery ventilator. The second embodiment, shown in FIG. 10 is adapted for connection to an existing system, such as an HVAC system present in homes, or in commercial or industrial buildings. FIGS. 2–5 show details of the present invention in the first embodiment which are representative of the structure present in the second embodiment, which has a slightly different shape of housing 14. Other details and alternative configurations of the present invention, shown in FIGS. 6–9B and 11, are applicable to all embodiments.

Figure 4:
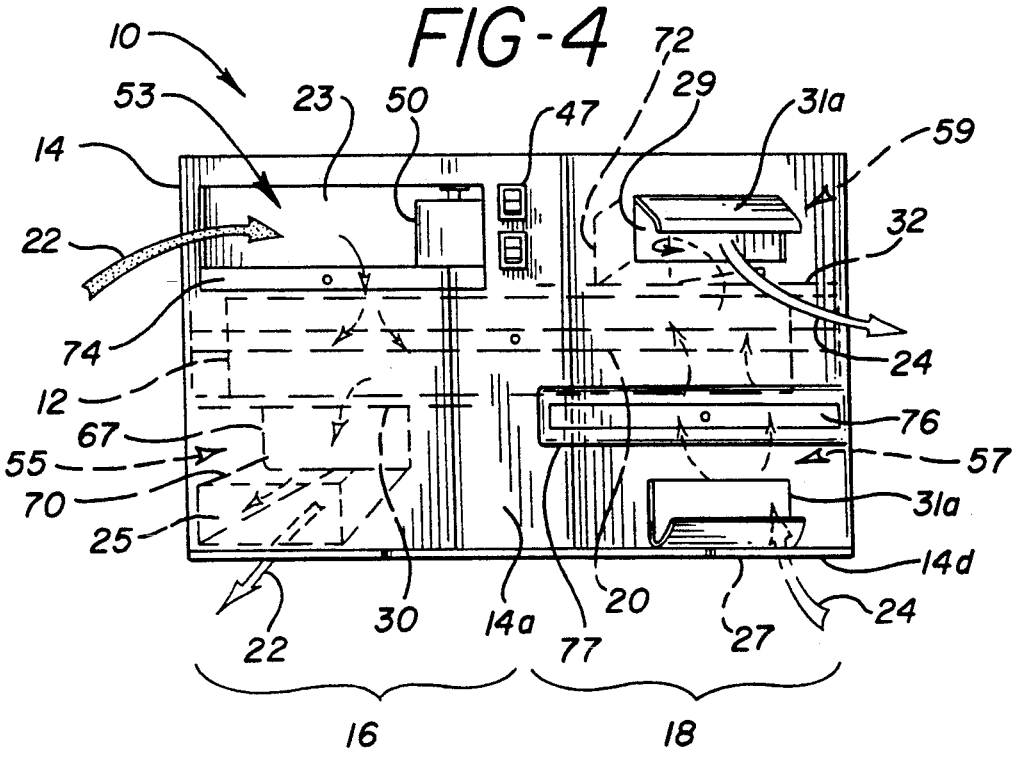
FIG. 4 is a front elevational view of the heat recovery ventilator of FIG. 1 with the front panel and top panel removed.
Figure 5:
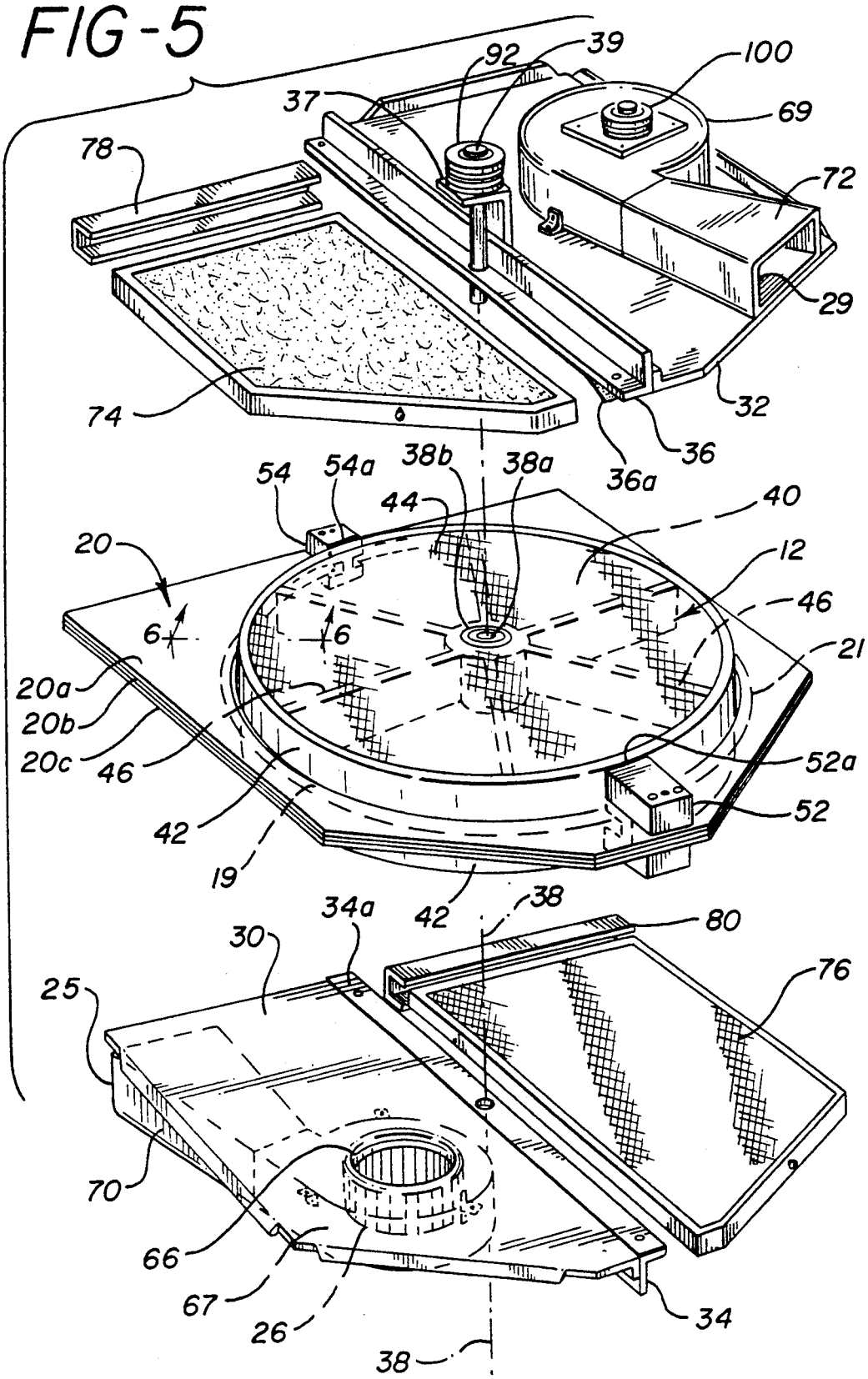
FIG. 5 is an exploded view of the inner components of the heat recovery ventilator of FIG. 2.

Means for forcing the first and second streams of air 22, 24 through the first and second sections 16, 18 are shown as two alternatives in the present invention, but may include other of a similar nature. In the first embodiment of FIGS. 1–5, means for forcing the first and second streams of air 22, 24 are first and second centrifugal impellers 26, 28, preferably forward curved centrifugal impellers such as are used in blowers. As best shown in FIG. 5, centrifugal impellers 26, 28 are preferably located near the outlets 25, 29 of first and second sections 16, 18 on opposite sides of heat exchanger 12. Centrifugal impellers 26, 28 are mounted in first and second centrifugal impeller housings 67, 69, respectively. First and second centrifugal impeller housings 67, 69 are, preferably, expansion or catalog test housings, as understood in the art, and are disposed on first and second baffle assemblies 30, 32, respectively. Centrifugal impellers 26, 28 and centrifugal impeller housings 67, 69 are located over first and second apertures 66, 68 in first and second baffle assemblies 30, 32, respectively. The apertures 66, 68 are preferably funnel-shaped, opening wider on the side opposite the centrifugal impellers, with the walls of the funnel having a curvature to enhance the smooth flow of air into the centrifugal impellers 66, 68. First and second duct sections 70, 72 preferably connect first and second centrifugal impeller housings 67, 69, respectively, to first outlet 25 and second outlet 29, respectively. First and second duct sections 70, 72 are flared, as shown, for best performance of the centrifugal impellers 26, 28. In the second embodiment of FIG. 10 where like numbers represent like elements, first and second centrifugal impellers 26, 28, are representatively replaced by first and second axial impellers **26*a*, 28*a*, disposed as shown near the inlets 23, 27 of first and second sections 16, 18 in first and second axial impeller housings 67*a* and 69*a*. First and second axial impellers 26*a*, 28*a*, likewise have no separate motors. In the second embodiment of FIG. 10 where axial impellers 26*a*, 28*a* are disposed near the inlets 23, 27, baffle assemblies 30, 32 serve only as baffles, and do not include apertures 66, 68. Axial impellers 26*a*, 28*a* might also be placed near outlets 25, 29, positioned similarly to centrifugal impellers 26, 28, but with corresponding adaptation of baffle assemblies 30, 32 and duct sections 70, 72. Although axial impellers 26*a*, 28*a* are shown, centrifugal impellers 26, 28 and centrifugal impeller housings 67, 69** may, as well, be used in the second embodiment, preferably positioned as shown in the first embodiment.

Figure 2:
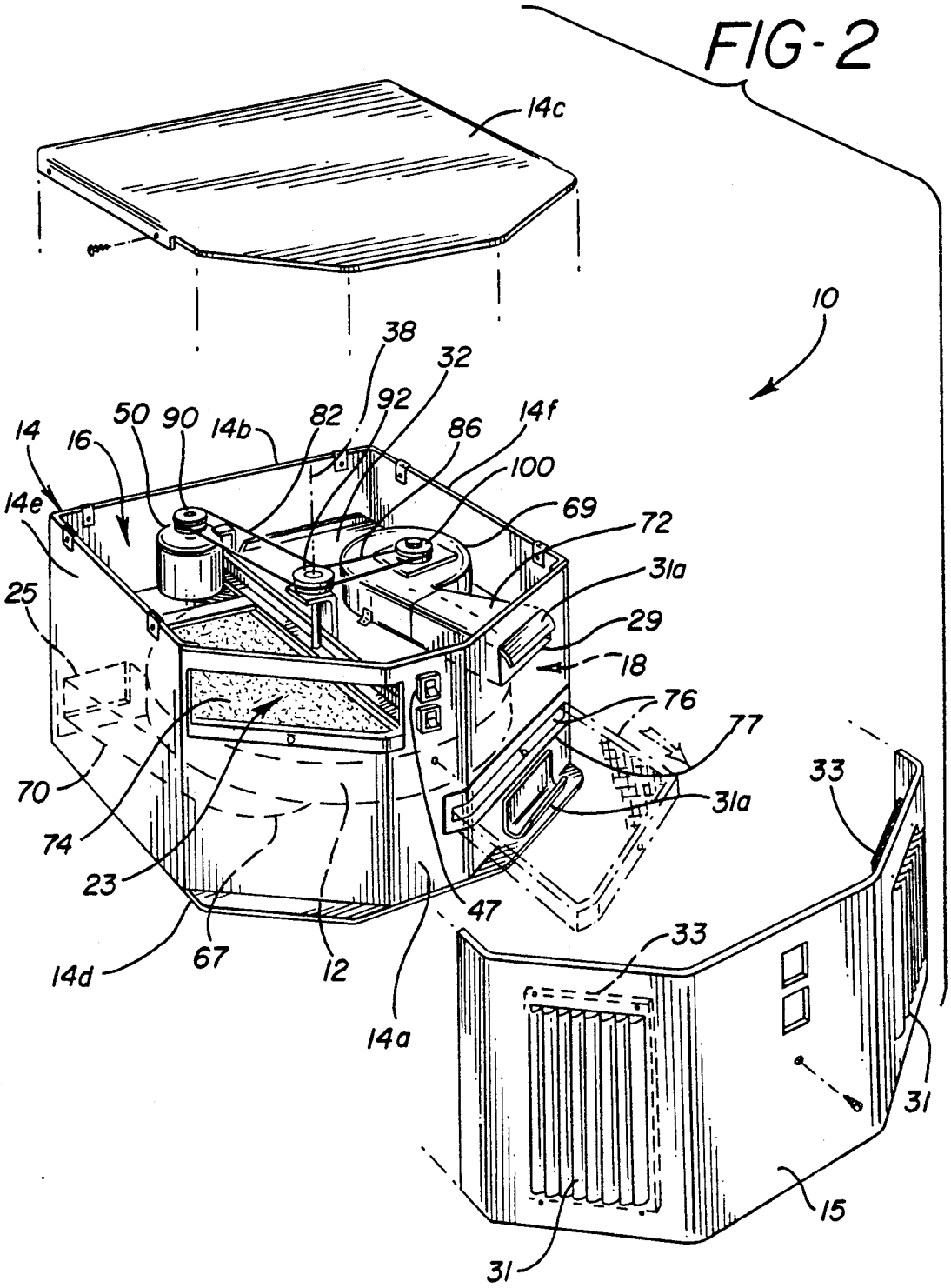
FIG. 2 is a partially exploded perspective view of the first embodiment of the heat recovery ventilator of FIG. 1 showing the top panel and front panel removed.
Figure 3:
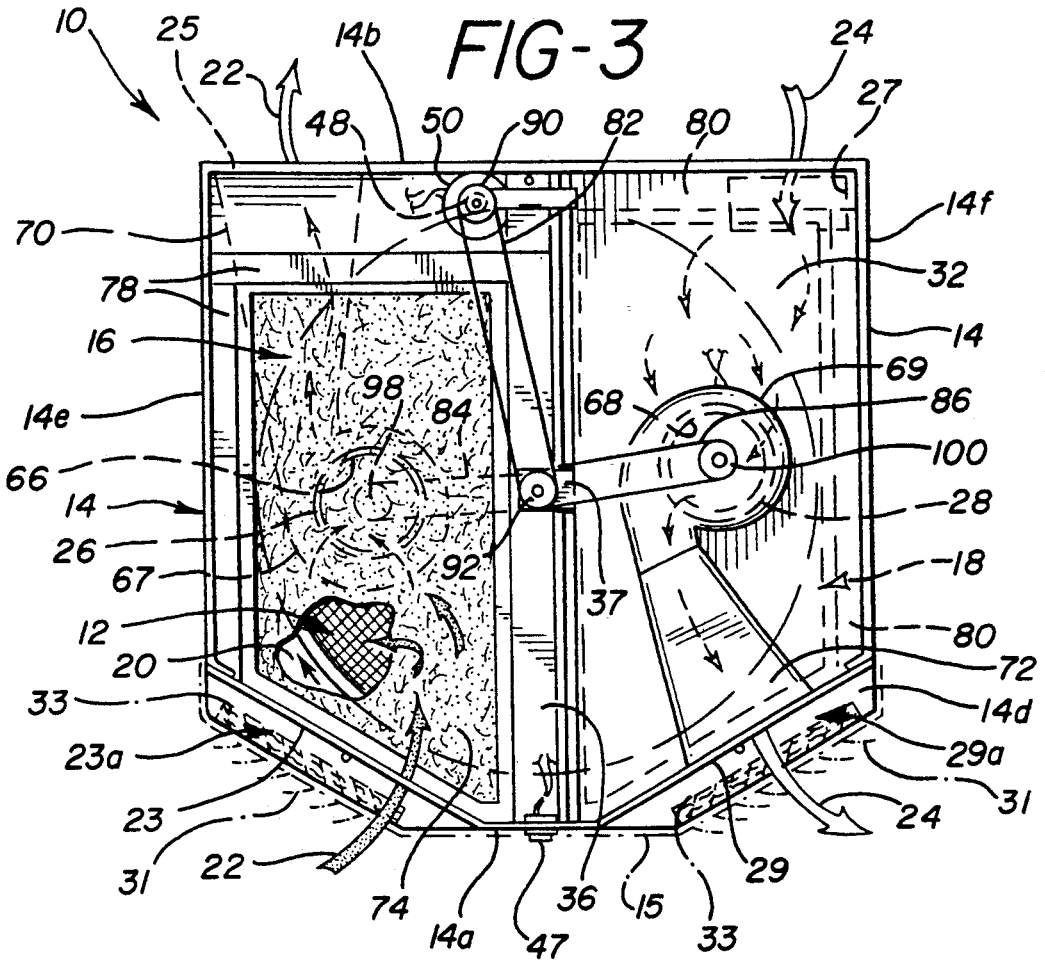
FIG. 3 is a top plan view of the heat recovery ventilator of FIG. 1 with the top panel removed.

As best shown in FIG. 8, the heat recovery ventilator 10 of the present invention uses a single source of rotary power to drive both the rotary wheel heat exchanger 12 and the centrifugal impellers 26, 28. In accordance with the present invention, a single motor or source of rotary power, operating at one speed, provides rotary motion to both rotate the heat exchanger at low revolutions per minute (RPM), typically 10–50 RPM, while simultaneously rotating centrifugal impellers 26, 28, axial impellers **26*a*, 28*a*, or other means for forcing, at high RPM, as high as thousands of RPM. Using a single source of rotary power eliminates both the cost and the noise associated with employing a plurality of motors to individually drive the heat exchanger 12 and impellers. Moreover, the noise level may be further reduced by strategically positioning the source of rotary power in portions of the housing 14 which extend away from the front face 14*a*. For example, as shown in FIGS. 2 and 3, where window-mounted units are provided, a drive motor 50 may be disposed in portions of the ventilator 10 which extend out the window, as shown in FIG. 1. Use of a single source of rotary power also provides a degree of design freedom, in that the speed of the impellers may be varied as needed rather than limited by available speeds from blower or fan manufacturers Referring again to FIG. 8, the source of rotary power preferably is a drive motor 50 having two drive shafts 49, 51. Referring to FIG. 10, alternatively, as representatively shown, the source of rotary power in the housing 14 could be driven by a power source external to the housing 14. An external power source may be available, for example, in commercial or industrial applications. As representatively shown in FIG. 10, the external power source is drive motor 50*a*, which drives the source of rotary power in the housing 14, drive shaft 49*a*. Drive shaft 49*a* extends outward through housing 14 to connect to the power source, and is preferably sealed at its point of exit by drive shaft seal 49*b*, which may be a packing or a bearing assembly, or other means for sealing. Another possible configuration is also shown in phantom in FIG. 10, where the source of rotary power in the housing 14 is drive shaft 49*c*, which is connected directly to central shaft 39. Drive shaft 49*c*, as shown, extends outward through housing 14 to connect to a power source, representatively shown as drive motor 50*b*, which drives the drive shaft 49*c*. A drive shaft seal 49*b* is, again, preferred. In this configuration drive shaft 49*a* is rotatably disposed entirely within housing 14 and is connected as shown to transmit rotary power to heat exchanger 12**.

Referring now to FIGS. 2, 3 and 8, rotary power is transmitted from the source of rotary power to the heat exchanger 12 and centrifugal impellers 26, 28 by a unique configuration of first and second means for transmitting rotary power. Shown best in FIG. 8, the first means for transmitting preferably includes a drive wheel 48 rotatably driven by attachment to the first drive shaft 49 of the drive motor 50. Drive wheel 48 frictionally engages the periphery of container 42 of the rotary wheel heat exchanger 12 and rotates the heat exchanger 12 about the central axis 38. The second means for transmitting rotary power drives the centrifugal impellers 26, 28 by means of a central shaft 39 which extends through the central axis 38 of the rotary wheel heat exchanger 12 and is rotatably driven by drive motor 50. The central shaft 39 thus extends beyond both sides of the heat exchanger 12 and is freely rotatable without effecting the rotation of the heat exchanger 12 by virtue of its bearing arrangement, shown in FIG. 9. Further, second means for transmitting, shown in FIG. 8, preferably includes means for rotatably driving the central shaft 39, including a first drive belt 82 and a first pulley 90 which is attached to the second drive axle 51 of the drive motor 50. The first drive belt 82 also engages a second pulley 92 on the central shaft 39 and rotates the central shaft 39. Third and fourth pulleys 94, 96 are also disposed on central shaft 39 on opposite sides of heat exchanger 12. Second and third drive belts 84, 86, respectively, are engaged therein, and further engage fifth and sixth pulleys 98, 100 on the centrifugal impellers 26, 28, respectively, to rotatably drive the first and second centrifugal impellers 26, 28.

Referring to FIG. 10, in the second embodiment where the source of rotary power in housing 14 is drive shaft 49*a*, shaft 49*a* to rotate heat exchanger 12 and central shaft 39, respectively, in a manner as described above.

In designing the impellers of the present invention, the first, second, third, fourth, fifth and sixth pulleys 90–100 may be sized to provide the desired or optimal impeller speed for the application. Further, in operation, the drive motor speed may be varied by drive motor control 47 between fixed speeds, or varied between limits by an adjustable control.

Figure 9A:
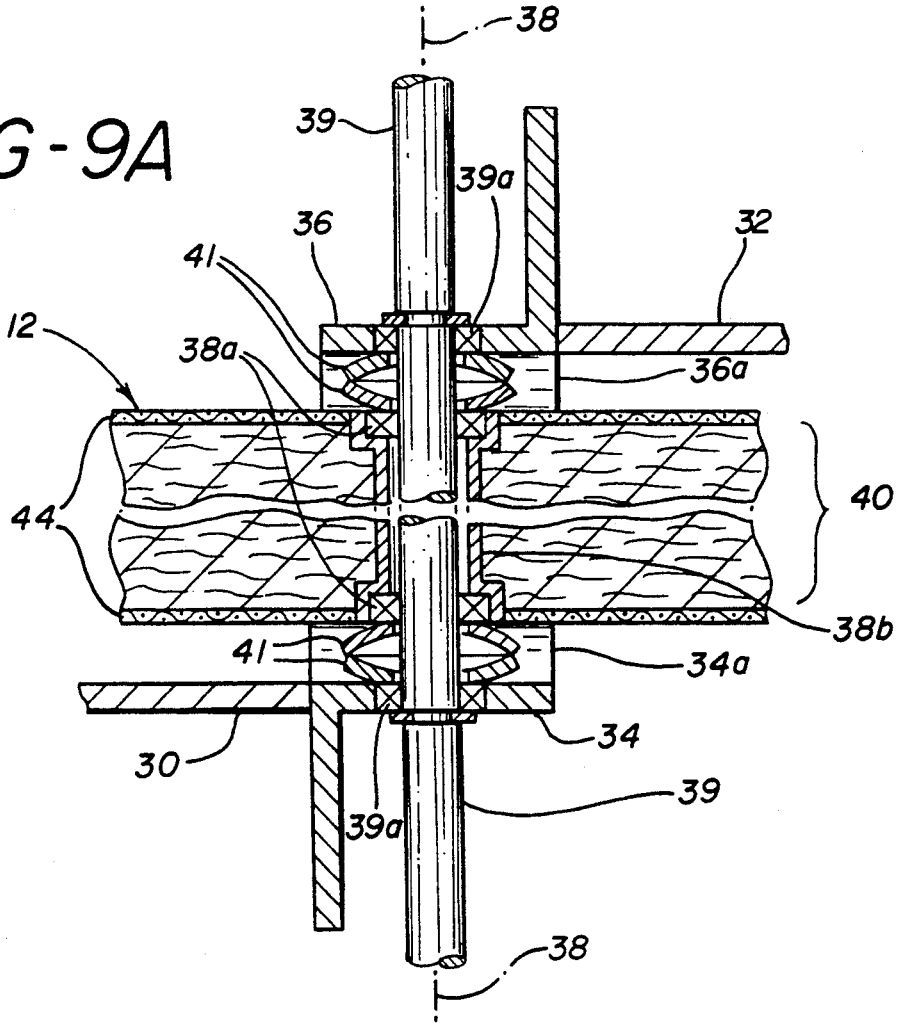
FIG. 9A is an enlarged detail cross-sectional view of the central axis and an alternative bearing arrangement supporting the central axis and rotary wheel heat exchanger of the present invention.
Figure 9:
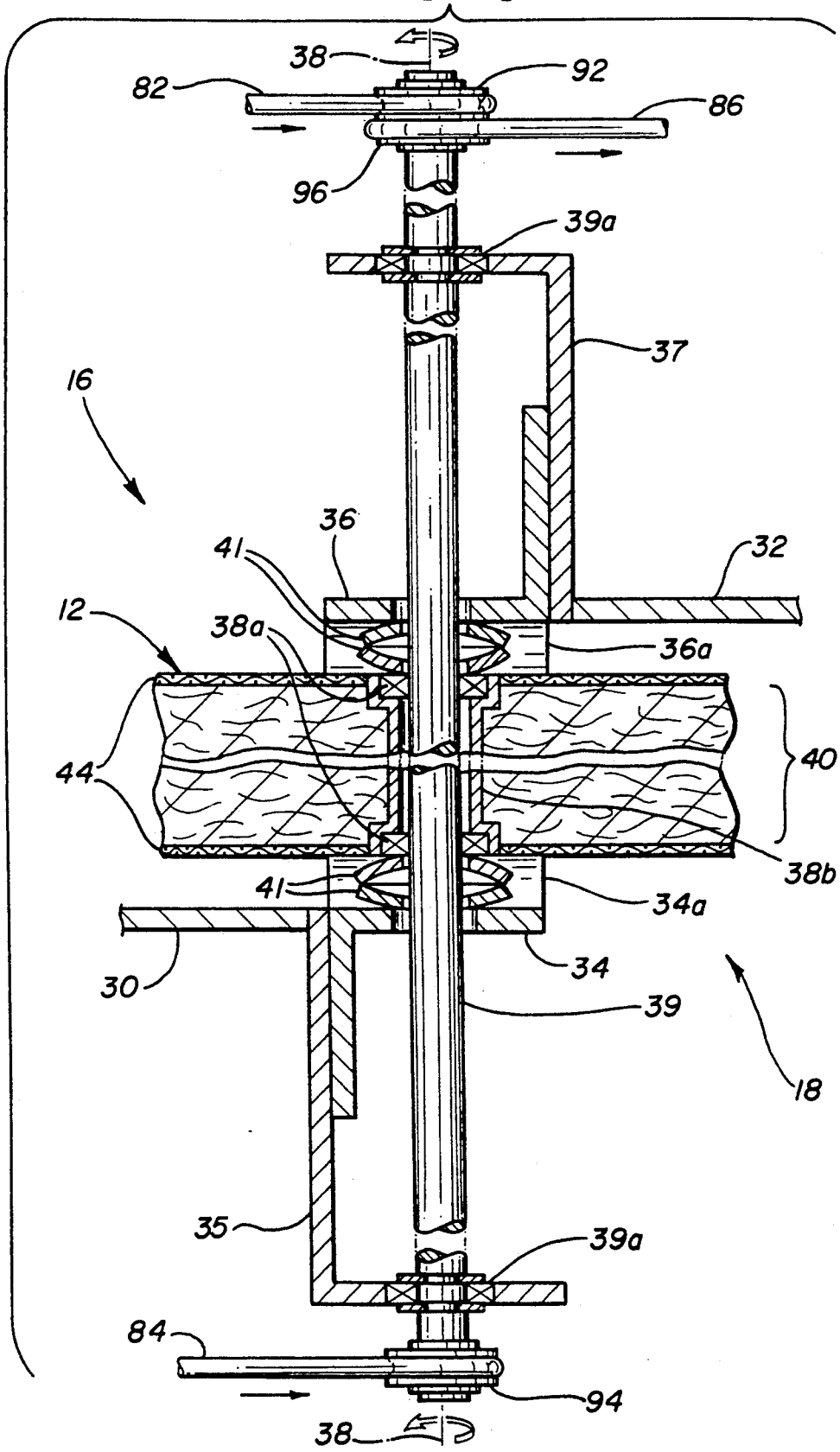
FIG. 9 is an enlarged detail cross-sectional view of the central axis and the bearing arrangement supporting the central axis and rotary wheel heat exchanger of the present invention.
Figure 10:
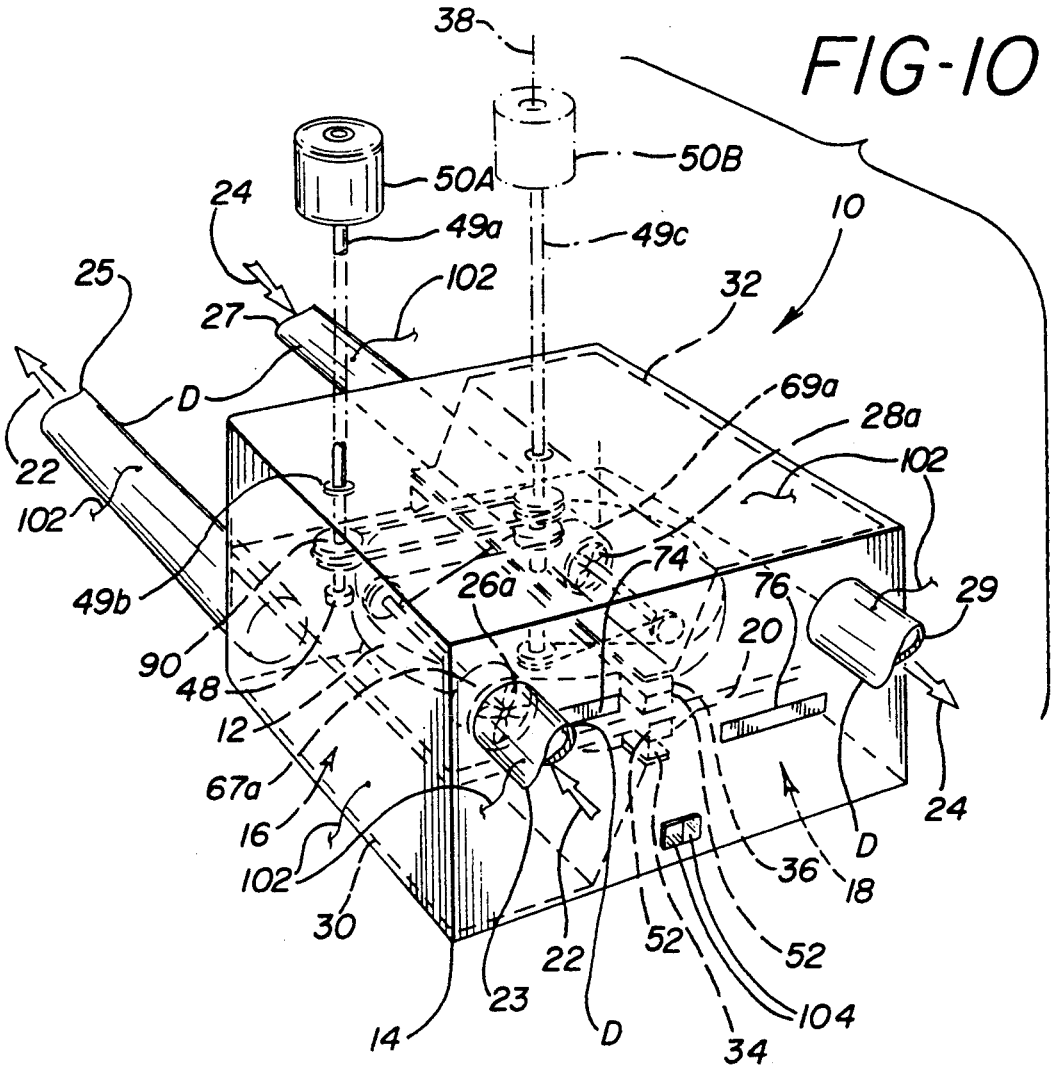
FIG. 10 is a perspective view of the second embodiment of the present invention where the heat recovery ventilator includes means for connecting to existing ducts, and where the heat recovery ventilator is shown driven by a source of rotary power located outside the housing, and employing axial impellers to force first and second streams of air.

Referring to FIG. 9, additional details of the preferred embodiment of the present invention may be examined in greater detail. Central shaft 39, rotatably mounted along central axis 38, is supported by mounting angles 35 and 37, which are attached to mounting angles 34, 36. Mounting angles 34 and 36 include seals 34*a* and 36*a*, such as polytetrafluoroethylene-power based tapes, which cover flanges of mounting angles 34 and 36, respectively. Seals 34*a* and 36*a* are designed to contact screens 44 initially and wear to a level which maintains a desired seal between air streams 22, 24. At least two shaft bearing assemblies 39*a* in mounting angles 35, 37 are used to support the central shaft 39, and at least one bearing assembly 38*a* disposed along the central axis 38, in turn, supports the rotary wheel heat exchanger 12 on the central shaft 39, whereon it is freely rotatable without effect on the rotation of the central shaft 39. The bearing assembly 38*a* is preferably press-fit into the hub of rotary wheel heat exchanger 12, but may also be fitted indirectly into the heat exchanger 12 by means of a bearing holder 38*b*, as shown. Disc spring washers 41, such as "Bellville" washers, are preferably included to maintain bearing assemblies 38*a* in rotary wheel heat exchanger 12, as shown. This compact configuration has been found to enable a single source of rotary power to drive the rotating components of the present invention using a minimum of space, without requiring additional seals and without presenting additional sealing problems between the streams of air 22, 24 in the first and second sections 16, 18 of the housing 14.

Figure 11:
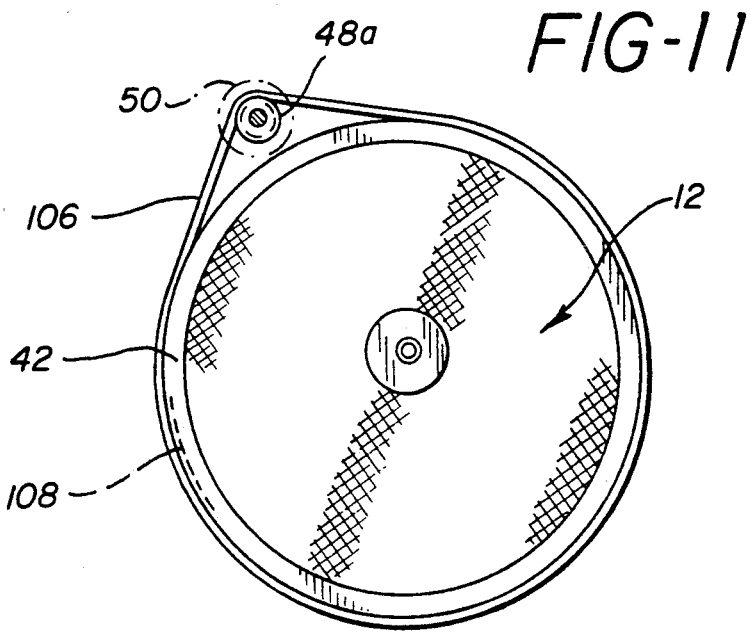
FIG. 11 is an alternative embodiment of the first means for transmitting rotary power to rotate the rotary wheel heat exchanger of the present invention.

As shown in FIG. 11, alternative first means for transmitting rotary motion to rotary wheel heat exchanger 12 include a drive pulley 48*a* and a heat exchanger drive belt 106 extending around the periphery of container 42. Means for retaining the drive belt on container 42 such as a groove 108, indentation, or a pair of generally parallel raised ribs are preferably provided on the periphery of container 42.

Figure 8A:
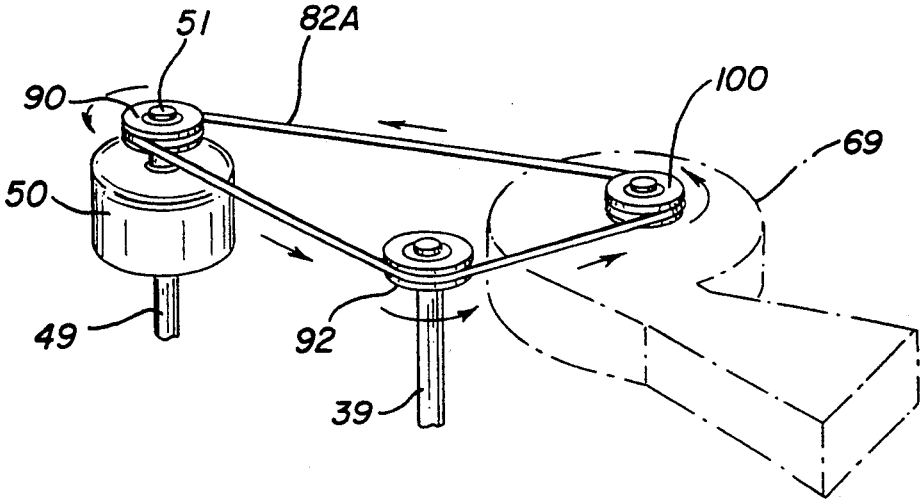
FIG. 8A is an enlarged detail perspective view of an alternative configuration of the second means for transmitting rotary motion from a drive motor to the impellers in the heat recovery ventilator of the present invention.
Figure 9B:
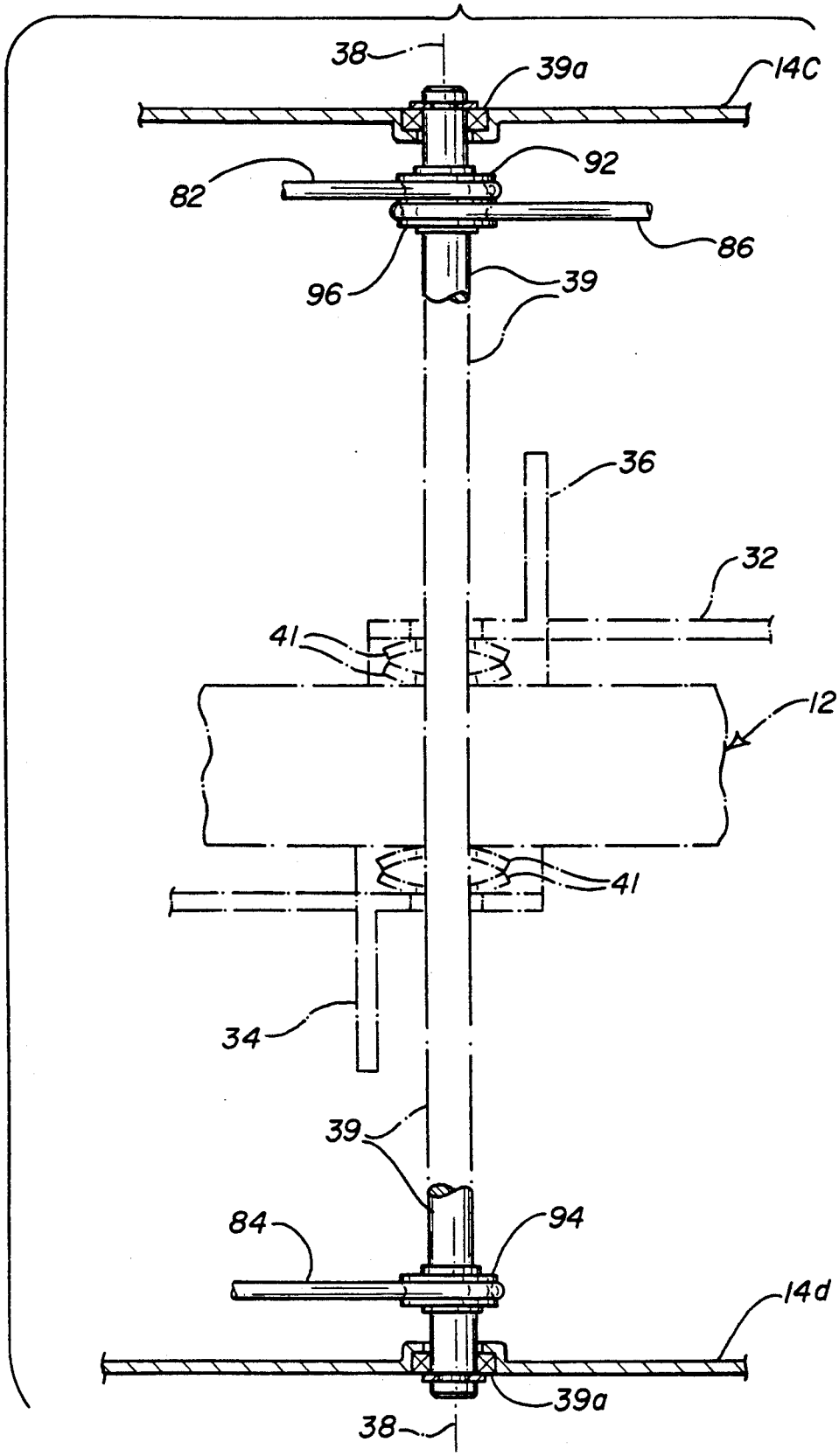
FIG. 9B is an enlarged detail cross-sectional view of the central axis and another alternative bearing arrangement supporting the central axis and rotary wheel heat exchanger of the present invention.

Alternative configurations of the second means for transmitting rotary motion are shown in FIGS. 8A, 9A and 9B. In one alternative configuration, shown in FIG. 8A, the first drive belt 82*a* is used to both drive the central shaft 39 and the centrifugal impeller 28 adjacent thereto, eliminating third drive belt 86 and fourth pulley 96. In another alternative configuration, shown in FIG. 9A, the shaft bearing assemblies 39*a* are disposed in mounting angles 34, 36 on each side of the rotary wheel heat exchanger, and may be included therein in addition to, or separately from, shaft bearing assemblies 39*a* in mounting angles 35, 37. In a third configuration of the second means for transmitting, shown in FIG. 9B, the shaft bearing assemblies 39*a* are disposed in the sides of the housing 14. While FIG. 9B shows the shaft bearing assemblies 39*a* disposed in top and bottom panels 14*c* and 14*d*, depending on the orientation of the housing, the embodiment of the invention, and configuration of components therein, the shaft bearing assemblies 39*a* may be disposed in other panels of the housing 14, such as left and right side panels 14*e* and 14*f*.

The use of drive belts and pulleys in first and second means for transmitting rotary power are preferred, and representative of elements included in the first and second means for transmitting which may, alternatively include gears, levers, and the like, not shown, which also would serve to transmit rotary power. Such alternative means would, nonetheless, be configured to transmit rotary power from a single source of rotary power and rotatably drive both the rotary wheel heat exchanger 12 and the means for forcing. The latter would be driven via the central shaft 39, with the central shaft 39 disposed and operated in accordance with the present invention to transmit rotary power from the single source of rotary power to the means for forcing.

As may be understood from FIG. 5, mounting angles 34, 36 are in turn supported by mounting angle holders 52 and 54 which are attached to the peripheral baffle 20 by conventional means. Mounting angle holders 52 and 54 are preferably injection molded, or alternatively, machined, to tight tolerances to match as closely as possible to the outer circumference of container 42 and provide a seal between streams of air 22, 24. Although not preferred, seals 52*a* and 54*a*, also shown in FIG. 7, such as polytetrafluoroethylene-based tapes, may also be placed on surfaces of mounting angle holders 52 and 54 adjacent to the container 42. Designed to initially contact container 42, seals 52*a* and 54*a* wear to a level which is designed to maintain the desired seal between air streams 22 and 24.

As well, flexible seals 19 and 21, shown in FIGS. 5–7, are preferably made of a polytetrafluoroethylene-based material and are attached to peripheral baffle 20 to prevent streams of air 22 and 24 from circumventing heat exchanger 12. As shown in FIG. 6, flexible seals 19 and 21 are preferably disposed in a groove 20*d* formed between three sheets 20*a*, 20*b* and 20*c* which comprise peripheral baffle 20. Best shown in FIG. 7, resilient means for joining, such as springs 17, are disposed in holes through mounting angle holders 52, 54, and attached to flexible seals 19 and 21 to keep flexible seals 19 and 21 in sealing contact with the outer circumference of container 42.

In accordance with the present invention, as shown in FIGS. 2–5, the heat recovery ventilator 10 is further provided with first and second filters 74, 76 to filter the first and second streams of air 22, 24, respectively, and to protect the rotary wheel heat exchanger 12 from becoming dirty, loading up or clogging with particulates from the incoming air streams 22, 24. The first and second filters 74, 76 are positioned in the housing 14 near the inlets 23, 27 to each of the first and second sections 16, 18, respectively, and are made of conventional filter materials. Preferably, screen material is stretched across at least the downstream face of the filters 74, 76 to help retain and support the filter material in the filters 74, 76. To provide additional filtering and purification of the streams of air 22, 24, the filters 74, 76 may, alternatively, contain activated carbon or charcoal, disposed and retained by means known in the art. Regardless of the filter type, in accordance with the present invention the filters 74, 76 are, preferably, both removable from one face of the housing 14, for ease of maintenance. Filter positioning angles 78, 80, shown in FIGS. 3 and 5, may be provided to form tracks upon which filters 74, 76 may be slidably inserted into and removed from housing 14. Where the ventilator 10 is window-mountable or otherwise extending through a wall, the preferred face from which the filters 74, 76 are accessible is the inside., front face 14*a*, as shown in FIG. 2. As shown in FIG. 2, only a single fastener needs to be removed to release front panel 15, and gain access to remove or replace filters 74, 76. This feature makes the present invention user-friendly and easy to maintain.

The user-oriented design of the present invention is also enhanced by preferred positioning of impellers to allow easy access to remove, replace or inspect drive belts 82, 84 and 86 through inlet 23 and inspection plate 77 at the front face of housing 14. Inspection plate 77 is shown in FIGS. 2 and 4 surrounding filter 76. Access to the drive belt 84 is provided by removing filter 76, and then inspection plate 77, which expands the opening sufficiently to provide the needed access. Inspection plate 77 is preferably made of the same material as housing 14.

To further inhibit the build-up of particulate or other material on the heat exchanger, the centrifugal impellers 26, 28 are preferably positioned by the heat exchanger 12 in the first and second streams of air 22, 24 nearest their respective outlets 25, 29. Where counterflow streams of air are provided, as is preferred, this position advantageously provides suction pressure in one stream of air to immediately remove particulate and other material which is driven to the surface of the rotary wheel heat exchanger 12 by the other stream of air. Similarly, moisture attracted to or condensed in the heat exchanger media at an inlet 23, 27 is reintroduced in the countervailing exhaust stream, and thus the present invention may also serve as a moisture exchanger. To avoid unnecessary and unwanted introduction of moisture into the second stream of air 24, second inlet 27 is positioned on the bottom panel 14*e* to inhibit the entry of rain into the housing 14.

Referring to the first embodiment shown in FIG. 3, the housing 14 of the heat recovery ventilator 10 includes a frame comprising front face 14*a*, back panel 14*b*, and left and right side panels 14*e* and 14*f*, respectively. The top and bottom panels 14*c* and 14*d*, respectively, are removable, as shown. Referring to FIGS. 1–3, the heat recovery ventilator 10 of the second embodiment further preferably includes a removable front panel 15 which covers the front face 14*a* of the housing 14, and defines an inlet plenum 23*a* and an outlet plenum 29*a* for the first and second streams of air 22, 24, respectively. As seen best in FIG. 2, these plenums 23*a*, 29*a* provide a larger area for vents 31 in the front panel 15 than is otherwise available at front face 14*a* with the compact ventilator design incorporated herein. Vents 31 in the front panel 15 preferably have adjustable vanes to assist in directing the streams of air 22, 24 and to prevent recirculation. The shape of the front panel 15 also inhibits recirculation by facing vents 31 associated with streams of air 22, 24 in generally divergent directions. Diffuser baffles 31*a* may be included in the outlet plenum 29*a* to deflect, diffuse and dampen the force of the second stream of air 24 entering into a room or area through the related vent 31. Finally, light diffusers 33 are preferably included on the inside of front panel 15 covering both vents 31 to block the view of housing 14 and interior components of the heat recovery ventilator 10 through vents 31. Light diffusers 33 are preferably a highly porous foam filter material providing a sufficient degree of optical density, but substantially free flow of streams of air 22, 24 therethrough.

In the second embodiment of FIG. 1, where the heat recovery ventilator 10 is adapted for use in air handling systems, such as HVAC systems, the housing 14 is preferably square, as shown. In the second embodiment, the front panel 15 present in the first embodiment is eliminated along with the inlet and outlet plenums 23*a*, 29*a* defined thereby. As the first and second streams of air 22, 24 are provided from existing ducts D, the housing 14 of the second embodiment includes means for connecting 110 to existing ducts, pipes or the like, present in the system. Thus, as the application requires, some or all of the inlets 23, 27 and outlets 25, 29 to the first and second sections 16, 18 of the housing 14 include means for connecting 110 to existing systems. Such means for connecting 110 include, for example, male duct nipples with corrugated ends, a flange mounted on the inside or outside of housing, a bolt pattern, or other known means for connecting ducts, pipes, and the like.

Referring to FIGS. 10 and 1, an alternative configuration of the second embodiment of the heat recovery ventilator 10 may have a front face 14*a* and include a front panel 15, as shown in FIG. 1 to ventilate a room or space, while the heat recovery ventilator 10 connects to an existing system at first outlet 25 and second inlet 29, as shown in FIG. 10.

Shown representatively in the second embodiment of FIG. 10, the heat recovery ventilator 10 may also include one or more temperature sensors 102, such as thermocouples, and temperature readouts 104, adapted for use therewith, to monitor the ambient temperature of air, the temperature of streams of air 22, 24, or the temperature of any components of the heat recovery ventilator. The temperature readout 104 is preferably disposed on the front face 14*a* or front panel 15 of ventilator 10.

Referring to FIGS. 3 and 4, the path of first and second streams 22, 24 through first and second sections 16, 18 may be summarized in view of the components described above. In the first embodiment, the first stream of air 22 enters through a vent 31 into inlet plenum 23*a* and through inlet 23 into first inlet chamber 53. First inlet chamber 53 is defined by portions of housing 14, peripheral baffle 20, heat exchanger 12, second centrifugal impeller housing 69, and second baffle assembly 32. First stream 22 passes through first inlet chamber 53, across both first filter 74 and heat exchanger 12, and into first outlet chamber 55. First outlet chamber 55 is defined by portions of first baffle assembly 30, peripheral baffle 20, housing 14 and heat exchanger 12. First stream 22 passes through first outlet chamber 55, first centrifugal impeller 26 and first centrifugal impeller housing 67, into first duct section 70, and out through first outlet 25.

Still referring to FIGS. 3 and 4, summarizing the path of second stream 24, second stream 24 enters through the second inlet 27, disposed on the bottom panel 14*d* of the housing 14 into second inlet chamber 57. Second inlet chamber 57 is defined by portions of housing 14, peripheral baffle 20, heat exchanger 12, first centrifugal impeller housing 67, and first baffle assembly 30. Second stream 24 passes through second inlet chamber, across both second filter 76 and heat exchanger 12, into second outlet chamber 59. Second outlet chamber 59 is defined by portions of second baffle assembly 32, peripheral baffle 20, housing 14 and heat exchanger 12. Second stream 24 passes through second outlet chamber 59, second centrifugal impeller 28 and second centrifugal impeller housing 69 into second duct section 72. As second stream 24 exits through second outlet 29, at least part of the stream 24 encounters diffuser baffle 31*a* which deflects and diffuses air in second stream 24 as it continues through outlet plenum 29*a* and out the vent 31.

In the second embodiment of FIG. 10, the first and second streams of air 22, 24 will follow a similar path where centrifugal impellers 26, 28 (not shown) are used, except that the streams of air 22, 24 do not pass through an inlet plenum 23*a* or outlet plenum 29*a*, as neither are preferred in the second embodiment. Where axial impellers 26*a*, 28*a* are used and centrifugal impellers omitted, as shown in FIG. 10, the first and second streams of air 22, 24 encounter axial impellers 26*a*, 28*a*, and axial impeller housings 67*a*, 69*a*, respectively, upon entering the respective first and second inlet chambers 53 and 57, but otherwise follow substantially the same course through the first and second sections 16, 18, as recited above, again except that the streams of air 22, 24 do not pass through inlet or outlet plenums, which are not preferred and thus not included.

The heat recovery ventilator 10 of the present invention also includes a novel, low cost heat exchange media, referred to herein as random matrix media 40. As the heat exchanger 12 rotates, the random matrix media 40 transfers sensible and latent heat energy between first and second streams of air 22, 24 or other gas through which it passes. While the description herein refers to air, it is understood that the present invention may be used with other gases.

The random matrix media 40 of the present invention is comprised of a plurality of interrelated small diameter, heat-retentive fibrous material, which, relative to the prior art of ordered passages, layers, strands and patterns, appear random. The random interrelation or interconnection of fibrous material, by any of various chemical, mechanical or thermal means for interrelating, results in a mat of material of sufficient porosity to permit the flow of air therethrough, yet of sufficient density to induce turbulence and provide necessary surface area for heat transfer The random matrix media, preferably, forms a mat of material which is easy to work with, handle and cut to shape. The random matrix media may be made from one or more of many commercially available filaments, fibers, staples, wires or yarn materials, natural (such as metal wire) or man-made (such as polyester and nylon). Filament diameters from substantially about 25 microns to substantially about 150 microns may be used, and single strand filaments from substantially about 25 microns to substantially about 80 microns in diameter are preferred. Below substantially about 25 microns, the small size of the filaments creates excessive resistance to results due to decreased surface area of the larger filaments. The mat of material which forms the random matrix media should have a porosity (i.e., percentage of open space in total volume) of between substantially about 83% and substantially about 96%, and preferably from substantially about 90% to substantially about 94%. Below substantially about 83%, resistance to air flow becomes too great, and above substantially about 96% heat transfer becomes ineffective due to the free flow of air. Preferably the mat thickness should be less than 6" to prevent excessive resistance to air flow. Representative of random matrix materials which may be used in heat exchanger 12, 60 denier polyester needle-punch felt has a specific gravity of approximately 1.38, thermal conductivity of approximately 0.16 watts/m °K., specific heat of approximately 1340 j/Kg °K., filament diameters of about 75 to 80 microns, and porosity of about 92.5%.

Shown best in FIG. 8, the random matrix media 40 is enclosed by a container 42 and retained therein by various means for supporting, preferably including screens 44 stretched over apertures in the faces of the container 42, and radial spokes 46 extending from the hub of the container 42 through the random matrix media 40. Seals placed between the heat exchanger 12 and various elements in the housing 14 to prevent mixing of the separate first and second streams of air 22, 24 and cause the streams of air to flow through heat exchanger 12. Those seals include flexible seals 19, 21 between the heat exchanger 12 and peripheral baffle 20, and seals 34*a* and 36*a* between the heat exchanger 12 and mounting angles 34, 36, and where used, seals 52*a* and 54*a* on mounting angle holders 52, 54. Container 42 is preferably made of a light-weight material whose coefficient of expansion generally matches that of the aluminum preferably used for mounting angles 34, 36. Where, for example, 6063-T6 aluminum is used for mounting angles 34, 36, a 30% glass-filled polyester plastic, such as VALOX 420, Grade 420-SEO from The General Electric Co., is preferred because of its closely matching coefficient of expansion, 1.4 inches/inch °Fahrenheit (°F.).

Wheel 48 used to rotate heat exchanger 12 is preferably made of a rubber having characteristics which promise a long life expectancy for the frictional application of the present invention and for the range of temperatures in which heat recovery ventilator 10 or 60 is expected to operate. A preferred rubber for applications in the expected range of ambient temperatures for air, generally −20° to 130° F., is a carboxylated nitrile available from the Rubber Development Corp, San Jose, Calif.

The heat transfer efficiency of the random matrix media 40 and related material characteristics, such as the deliberate inducement of turbulence and the large surface area for heat transfer, promote a minimal heat exchanger thickness, and assist in the provision of an inexpensive, compact, portable heat recovery ventilator 10.

In operation, rotation of heat exchanger 12 is preferably between about 10 revolutions per minute (rpm) and about 50 rpm. Below about 10 rpm, overall efficiency of the heat recovery ventilator 10 declines. Above about 50 rpm, cross-over or mixing between air streams 22 and 24 occurs as heat exchanger 12 rotates, reducing the amount of ventilation provided.

Precise selection of material, composition, filament size, porosity and width of the random matrix media 40 as well as the rate of rotation of heat exchanger 12 and selection of size and type of impellers may vary with each application. However, once the size and flow (and, in some cases, the gas) required for a particular application are fixed, the impellers, drive motor 50, drive pulleys 80–90, type of filters 74, 76 and other components may be selected or sized, and the random matrix media 40 selected from appropriate materials with appropriate filament size, porosity and other characteristics noted above. In addition, it is possible to combine a plurality of rotary wheel heat exchangers 12 in a single housing 14 to provide high capacity heat exchange. One such application would be in ventilating large commercial or industrial buildings, for example with a 30,000 cubic feet per minute (cfm) multi-heat exchanger unit. Regardless of the size, and number of heat exchangers 12 in housing 14, a single source with the present invention to rotate the heat exchangers 12 and means for forcing streams of air 22, 24 therethrough. Chart 1 below lists typical parameters for the present invention in representative applications for air.

Chart 1: Representative Heat Recovery Ventilator Applications

| Air Flow (cfm) | Application | Heat Exchanger Disk Diameter (cms) | Heat Exchanger RPM | Impeller Static Pressure (inches of water) | Effectiveness (%) |
|---|---|---|---|---|---|
| 20 | Room | 25 | 20 | .12 | 92.0% |
| 30 | Room | 25 | 20 | .20 | 90.0% |
| 80–150 | Small to medium-sized houses | 43 | 35–45 | .35 | 90.0% |
| 200 | full medium | 80 | 20 | .11 | 92.5% |
| | to large house | 43 | 40–50 | .45 | 90.0% |
| 300 | Large house | 80 | 20 | .18 | 91.0% |
| 500 | Small commercial such as a restaurant | 100 | 40 | .20 | 91.0% |
| 650 | Small to medium commercial | 100 | 40 | .27 | 90.0% |
| 30,000 | large commercial, or industrial | variable depending on application, pressure losses in duct work, etc. | | | 90.0% |

All components of heat recovery ventilator 10 are commercially available and made of materials known and used in the art, except for special materials applications noted above. Housing 14, various baffles 20, 31*a*, baffle assemblies 30, 32, centrifugal impeller housings 67, 69 or axial impeller housings 67*a*, 69*a*, mounting angles 34–37, positioning angles 78, 80 and first and second duct sections 70, 72 are preferably made of lightweight materials such as plastic, blow-molded, injection-molded, or thermoformed, although aluminum or mild steel are suitable materials, as well. It is preferred that multiple elements of the present invention be combined into one-piece moldings in a manner known in the art. For example, it is preferred that the first baffle assembly 30, first duct section 70 and first centrifugal impeller housing 67 for first centrifugal impeller 26 be injection-molded as substantially one piece, with a plate added which included aperture 66 and which serves to complete baffle assembly 30 while also completing the duct section 70 and centrifugal impeller housing 67. Similar pieces are preferably injection-molded for second baffle assembly 32, second duct section 72 and second centrifugal impeller housing 69. All components are connected by conventional means such as bolts and nuts, rivet, welding, adhesives, bendings sealing or the like. Conventional seals or sealant material (not shown) may also be further used to seal the various elements where connected to prevent intermixing of streams of air 22, 24, or leakage of ambient air.

While certain representative embodiments and details have been shown and described for purposes of illustrating the invention, it will be apparent to those skilled in the art that various changes in the apparatus disclosed herein may be made without departing from the scope of the invention which is defined in the appended claims. It is further apparent to those skilled in the art that applications using the present invention with gases other than air may be made without departing from the scope of the invention defined in the appended claims.

What is claimed is:

1. A compact heat recovery ventilator comprising:

a housing having first and second sections to convey separate first and second streams of air;

a heat exchanger rotatably disposed in said housing for rotation about a central axis, and adapted to intersect said first and second sections;

means for forcing said separate first and second streams through said first and second sections;

a source of rotary power;

first means for transmitting said rotary power to rotatably drive said heat exchanger; and second means for transmitting said rotary power to drive said means for forcing, said second means for transmitting comprising a central shaft rotatably driven by said source of rotary power, said central shaft extending through the central axis of said heat exchanger and freely rotatable therethrough and connected to said means for forcing.

2. A heat recovery ventilator as recited in claim 1 wherein said means for forcing comprises first and second impellers rotatably disposed in first and second impeller housings, respectively, said first and second impellers and impeller housings disposed in said housing to force said first and second streams through said first and second sections, respectively.

3. A heat recovery ventilator as recited in claim 2 wherein said first and second impellers comprise first and second centrifugal impellers, respectively, and said first and second impeller housings comprise first and second centrifugal impeller housings, respectively.

4. A heat recovery ventilator as recited in claim I wherein said source of rotary power comprises an electric drive motor having at least one rotary drive shaft.

5. A heat recovery ventilator as recited in claim 4 wherein said drive motor includes control means for varying the speed of said motor.

6. A heat recovery ventilator as recited in claim 1 wherein said source of rotary power comprises a drive shaft rotatably driven by a power source outside said housing.

7. A heat recovery ventilator as recited in claim 1 wherein said first means for transmitting said rotary power comprises a drive wheel attached to said source of rotary power, said drive wheel frictionally engaging at least a portion of the periphery of said heat exchanger.

8. A heat recovery ventilator as recited in claim 1 wherein said first means for transmitting said rotary power comprises a drive wheel attached to said source of rotary power, said drive wheel adapted to retain and drive a peripheral drive belt which frictionally engages at least a portion of the periphery of said heat exchanger, whereby said heat exchanger is rotated.

9. A heat recovery ventilator as recited in claim 1 wherein said central shaft further includes at least one shaft bearing assembly disposed in said housing upon which said central shaft is supported and freely rotates.

10. A heat recovery ventilator as recited in claim 1:

wherein said means for forcing comprise first and second impellers positioned to force said first and second streams through said first and second sections, respectively; and wherein said second means for transmitting further includes:

a first pulley and first drive belt rotatably driven by said source of rotary power;

a second pulley disposed on said central shaft engaging said first drive belt and rotating said central shaft;

a third and fourth pulleys disposed on said central shaft;

fifth and sixth pulleys attached to said first and second impellers, respectively;

a second drive belt engaging said third and fifth pulleys to drive said first impeller; and a third drive belt engaging said fourth and sixth pulleys to drive said second impeller.

11. A heat recovery ventilator as recited in claim 10 wherein:

said housing has a plurality of faces; and said first, second and third drive belts are positioned so that all are accessible for removal from at least one face of said housing.

12. A heat recovery Ventilator as recited in claim I wherein said housing comprises a frame having one or more sides and having one or more apertures communicating with said first and second sections;

one or more mounting angles supported by said housing on opposite sides of said heat exchanger, said central axis extending therethrough;

a peripheral baffle secured to the inside of said housing, said peripheral baffle having an aperture wherein said heat exchanger may rotate;

one or more seals communicating between said peripheral baffle and said heat exchanger, adapted to prevent passage of air between said peripheral baffle and said heat exchanger; and one or more baffle assemblies further defining said first and second sections

13. A heat recovery ventilator as recited in claim 12:

wherein said frame has at least four apertures, said apertures including a first inlet and a first outlet related to said first section, and a second inlet and a second outlet related to said second section;

wherein portions of said frame, at least one of said one or more baffle assemblies, said peripheral baffle, and said heat exchanger define first and second inlet chambers for said first and second sections, respectively, said first and second inlet chambers communicating with said first and second inlets, respectively; and wherein portions of said frame, at least one of said one or more baffle assemblies, said peripheral baffle and said heat exchanger further define first and second outlet chambers for said first and second sections, respectively, said first and second outlet chambers communicating with said first and second outlets, respectively;

whereby said first stream is conveyed in said first section from said first inlet through said first inlet chamber, across said heat exchanger, and through said first outlet chamber to said first outlet; and said second stream is conveyed in said second section from said second inlet through said second inlet chamber, across said heat exchanger, and through said second outlet chamber to said second outlet.

14. A heat recovery ventilator as recited in claim 1 wherein said housing includes:

a peripheral baffle secured to the inside of said housing, said peripheral baffle having an aperture wherein said heat exchanger may rotate and further having a groove adapted to receive one or more seals;

one or more seals disposed in said groove and communicating between said peripheral baffle and said heat exchanger, said one or more seals adapted to prevent passage of air between said peripheral baffle and said heat exchanger;

at least one mounting angle holder disposed in said groove having an opening extending therethrough generally aligned with said groove, and through which said one or more seals may be resiliently joined; and means for resiliently joining said one or more seals, said means for joining substantially disposed in said opening in said mounting angle holder.

15. A heat recovery ventilator as recited in claim 1 wherein:

said housing comprises a frame having one or more sides and at least four apertures, said apertures including a first inlet and a first outlet related to said first section, and a second inlet and a second outlet related to said second section; and said housing further includes one or more vents associated with one or more of said apertures, said one or more vents adjustably positionable in one or more directions to direct said first and second streams conveyed by said first and second sections.

16. A heat recovery ventilator as recited in claim 1 wherein said heat exchanger comprises:

heat exchanger media;

a container enclosing said media and having one or more apertures along each of two parallel faces of said container;

means for supporting said media, said means for supporting said media comprising a plurality of spokes extending radially outward from the hub of said container to the periphery thereof, said spokes further extending axially substantially between said parallel faces; and screen material attached along said two parallel faces of said container, said container, said screen material and said media adapted to allow substantially free passage of air therethrough.

17. A heat recovery ventilator as recited in claim 1 wherein said heat exchanger includes at least one bearing assembly disposed along said central axis, whereby said heat exchanger may freely rotate about said second means for transmitting which extends through the central axis of said heat exchanger.

18. A heat recovery ventilator as recited in claim 1 wherein said heat exchanger comprises a random matrix media and means to support said random matrix media.

19. A heat recovery ventilator as recited in claim 18 wherein said random matrix media comprises randomly interrelated, small diameter, heat retentive, fibrous material.

20. A heat recovery ventilator as recited in claim 1 further comprising one or more filters removably disposed in at least one of said first and second sections, and means for retaining said one or more filters therein.

21. A heat recovery ventilator as recited in claim 20 wherein at least one first filter is removably disposed in said first stream of air, and at least one second filter is removably disposed in said second stream of air.

22. A heat recovery ventilator as recited in claim 21: wherein:

said housing has a plurality of faces; and said first and second filters are accessible for insertion and removal from one or more faces of said housing, at least one of said one or more faces from which said first and second filters are accessible comprising the same face of said housing.

23. A heat recovery ventilator as recited in claim 21 wherein at least one of said filters is a carbon filter.

24. A heat recovery ventilator as recited in claim 1 further comprising a front panel, portions of said front panel and said housing defining an inlet plenum communicating with said first section and an outlet plenum communicating with said second section.

25. A heat recovery ventilator as recited in claim 24 further comprising one or more diffuser baffles disposed in said outlet plenum.

26. A heat recovery ventilator as recited in claim 1 further comprising:

at least one temperature sensor; and a temperature sensor readout connected to said temperature sensor and disposed on said housing.

27. A compact heat recovery ventilator comprising:

a housing having first and second sections to convey separate first and second streams of air;

a heat exchanger rotatably disposed in said housing for rotation about a central axis, and adapted to intersect said first and second sections;

first and second impellers rotatably disposed in first and second impeller housings, respectively, to force said separate first and second streams through said first and second sections, respectively;

a drive motor;

a drive wheel rotatably driven by said drive motor and imparting rotation to said heat exchanger; and a central shaft rotatably driven by said drive motor and extending through said central axis of said heat exchanger, said central shaft freely rotatable therethrough and connected to said first and second impellers to rotatably drive said impellers.

28. A heat recovery ventilator as recited in claim 27 wherein said heat exchanger further includes at least one bearing assembly disposed along said central axis between said heat exchanger and said central shaft, whereby said heat exchanger is freely rotatable on said central shaft independent of the rotation of said central shaft.

29. A heat recovery ventilator as recited in claim 27 wherein said central shaft further includes at least one bearing assembly disposed along said central axis and supported by said housing, whereby said central shaft is freely rotatable in said housing, independent of the rotation of said heat exchanger.

30. A compact heat recovery ventilator comprising:

a housing having first and second sections to convey separate first and second streams of air, said first stream of air conveyed between a first inlet and first outlet, said second stream of air conveyed between a second inlet and second outlet;

a heat exchanger rotatably disposed in said housing for rotation about a central axis and positioned to intersect said first and second streams of air;

means for forcing said first and second streams through said first and second sections, respectively;

a source of rotary power;

first means for transmitting rotary power from said source of rotary power to the periphery of said heat exchanger to rotatably drive said heat exchanger; and second means for transmitting rotary power from said source of rotary power to operate said means for forcing, said second means for transmitting comprising a central rotatably driven by said source of rotary power and extending through the central axis of said heat exchanger, said central shaft freely rotatable therethrough and connected to said means for forcing;

whereby said source of rotary power peripherally drives aid heat exchanger, and operates said means for forcing.

* * * * *

UNITED STATES PATENT AND TRADEMARK OFFICE

CERTIFICATE OF CORRECTION

PATENT NO. : 5,285,842

DATED : February 15, 1994

INVENTOR(S) : Catherine J. Chagnot

It is certified that error appears in the above-indentified patent and that said Letters Patent is hereby corrected as shown below:

Column 16, line 57, "claim I" should be --claim 1--.

Column 17, line 42, "recovery Ventilator as recited in claim I" should be --recovery ventilator as recited in claim 1--.

Column 17, line 43, "housing comprises" shoula be --housing comprises:--.

Column 17, line 58, "second sections" should be --second sections.--.

Column 20, line 43, "central rotatably" should be --central shaft rotatably--.

Column 20, line 49, "drives aid heat" should be --drives said heat--.

Signed and Sealed this

Sixteenth Day of August, 1994

*Attest:*

Bruce Lehman

BRUCE LEHMAN

*Attesting Officer*

*Commissioner of Patents and Trademarks*